US008226855B2

(12) United States Patent
Manhardt et al.

(10) Patent No.: US 8,226,855 B2
(45) Date of Patent: Jul. 24, 2012

(54) PT OR PT ALLOY MATERIALS HARDENED BY OXIDE DISPERSION, PRODUCED BY INNER OXIDATION AND HAVING PROPORTIONS OF OXIDE AND GOOD DUCTILITY

(75) Inventors: Harald Manhardt, Bruchkoebel (DE); Tanja Eckardt, Dreieich (DE); David Francis Lupton, Gelnhausen (DE)

(73) Assignee: Heraeus Materials Technology GmbH & Co. KG, Hanau (DE)

( * ) Notice: Subject to any disclaimer, the term of this patent is extended or adjusted under 35 U.S.C. 154(b) by 869 days.

(21) Appl. No.: 12/030,910

(22) Filed: Feb. 14, 2008

(65) Prior Publication Data

US 2010/0276646 A1 Nov. 4, 2010

(30) Foreign Application Priority Data

Feb. 14, 2007 (DE) ..... 10 2007 007 873

(51) Int. Cl.
*H01B 1/02* (2006.01)
*H01B 1/22* (2006.01)

(52) U.S. Cl. ..... 252/514; 252/518.1; 148/242; 148/430

(58) Field of Classification Search ..... 252/514, 252/518.1; 75/234; 148/242, 430; 420/461, 420/467; 228/190
See application file for complete search history.

(56) References Cited

U.S. PATENT DOCUMENTS

| | | | | |
|---|---|---|---|---|
| 2,636,819 | A * | 4/1953 | Streicher | 420/461 |
| 3,622,310 | A * | 11/1971 | Reinacher et al. | 420/467 |
| 3,709,667 | A * | 1/1973 | Selman et al. | 75/234 |
| 3,779,714 | A * | 12/1973 | Nadkarni et al. | 75/234 |
| 3,868,530 | A | 2/1975 | Eaton et al. | |
| 4,123,263 | A | 10/1978 | Costin | |
| 4,274,852 | A * | 6/1981 | McGarry | 65/479 |
| 4,819,859 | A * | 4/1989 | Schwenninger | 228/190 |
| 5,129,572 | A | 7/1992 | Keilberth et al. | |
| 5,623,725 | A * | 4/1997 | Disam et al. | 419/19 |
| 6,129,997 | A * | 10/2000 | Braun et al. | 428/670 |
| 6,305,070 | B1 * | 10/2001 | Masur et al. | 29/599 |
| 6,663,728 | B2 * | 12/2003 | Manhardt et al. | 148/430 |
| 7,736,752 | B2 | 6/2010 | Manhardt et al. | |
| 2002/0022135 | A1 | 2/2002 | Kock et al. | |
| 2002/0056491 | A1 * | 5/2002 | Manhardt et al. | 148/242 |

FOREIGN PATENT DOCUMENTS

| | | | |
|---|---|---|---|
| CN | 1204695 | A | 1/1999 |
| DE | 1 533 273 | A | 2/1970 |
| DE | 1 783 074 | A | 3/1971 |
| DE | 31 02 342 | A1 | 11/1981 |
| DE | 3832342 | C1 | 7/1989 |
| DE | 19-714365 | A1 * | 10/1998 |
| DE | 197 14 365 | A1 | 10/1998 |
| DE | 100 46 456 | A1 | 4/2002 |
| DE | 197 58 724 | C2 | 12/2002 |
| EP | 0447820 | A2 | 9/1991 |
| EP | 0533385 | A1 | 3/1993 |
| EP | 0839553 | A2 | 5/1998 |
| EP | 0870844 | A1 | 10/1998 |
| EP | 0947595 | A2 | 10/1999 |
| EP | 1246330 | A2 | 10/2002 |
| EP | 1712646 | A1 | 10/2006 |
| GB | 1244253 | * | 8/1971 |
| GB | 2299813 | A | 10/1996 |
| JP | 2000-160268 | * | 6/2000 |
| JP | 2002-266040 | * | 9/2002 |
| WO | 2007019990 | A1 | 2/2007 |

OTHER PUBLICATIONS http://www.gleisbau-welt.de/site/schweissen/schweissverfahren.htm.

Office Action Issued Jun. 12, 2009 in U.S. Appl. No. 12/031,292.

Office Action issued Feb. 20, 2009 in EP Application No. 08000288.4.

Office Action issued May 20, 2010 in CN Application No. 200810144649.5.

* cited by examiner

*Primary Examiner* — Khanh Tuan Nguyen

(74) *Attorney, Agent, or Firm* — Panitch Schwarze Belisario & Nadel LLP

(57) ABSTRACT

A solid body of a metal alloy comprising less than 99% by weight of noble metal and more than 1% by weight of dispersion-strengthening metals is converted for production of a dispersion-strengthened platinum material by at least 90% oxidation of the dispersion-strengthening metals into a dispersion-strengthened platinum material. The dispersion-strengthened platinum material contains a noble metal component of platinum or a platinum alloy amounting to between 95 and 99% by weight and a dispersion-strengthening agent. The noble metal component includes at least 55% by weight Pt, 0 to 30% by weight Rh, 0 to 30% by weight Au, and 0 to 40% by weight Pd. The remaining proportion by mass of more than 1% by weight is a dispersion-strengthening agent, which contains at least one metal oxidized at least 90% by weight with oxygen, the metal being selected from the group of Ce, Zr, Sc, and Y.

18 Claims, No Drawings

PT OR PT ALLOY MATERIALS HARDENED BY OXIDE DISPERSION, PRODUCED BY INNER OXIDATION AND HAVING PROPORTIONS OF OXIDE AND GOOD DUCTILITY

BACKGROUND OF THE INVENTION

The invention relates to platinum or platinum alloy material dispersions strengthened by finely divided, small particles of non-noble metal oxide.

In German published patent application DE 31 02 342 A1, a grain-stabilized alloy is disclosed comprising a grain-stabilized component and, apart from impurities, gold and one or more metals of the platinum group as a remainder, wherein the group of platinum metals includes platinum, rhodium, palladium, ruthenium, and iridium, the grain-stabilized component being an oxide, carbide, nitride and/or silicide of scandium, yttrium, thorium, zirconium, hafnium, titanium, aluminum or a lanthanide, the proportion of the grain stabilized component not exceeding 0.5% by weight, and the proportion of gold being in a range of 2 to 10% by weight.

In German published patent application DE 197 14 365 A1, a platinum material dispersion is disclosed, which is strengthened by finely divided, small particles of non-noble metal oxides, the non-noble metal being cerium or a mixture of at least two of the elements of yttrium, zirconium and cerium, the non-noble metal content amounting to 0.005 to 1% by weight, at least 75% by weight of the non-noble metal being present as oxide and the formation of the non-noble metal oxide involving the thermal treatment of a platinum non-noble metal alloy present in compact form in an oxidizing medium at 600 to 1400° C.

German published patent application DE 100 46 456 describes a dispersion-strengthened Pt material free of Au, which contains either 0.01 to 0.5% by weight of Sc or 0.05 to 0.5% by weight of Sc in mixture with Zr, Y or Ce.

BRIEF SUMMARY OF THE INVENTION

An object of the present invention is to save on Pt without sacrificing quality.

According to the invention, a dispersion-strengthened platinum material comprises less than 99% by weight, preferably between 95 and 99% by weight, of a noble metal component of platinum or a platinum alloy comprising at least 55% by weight Pt, 0 to 30% by weight Rh, 0 to 30% by weight Au, and 0 to 40% by weight Pd, and the remaining more than 1% by weight, preferably 1 to 5% by weight, being a dispersion-strengthening agent comprising at least 90% by weight of at least one oxygen-oxidized metal selected from the group of Ce, Zr, Sc and Y. The dispersion-strengthening agent preferably contains at least 90% oxidized Ce or Zr, in the case of Zr additionally also Sc or Y. Based on the body volume, more than 10% by volume of noble metal, particularly Pt, can be saved according to the invention without loss of quality. Preferably, the noble metal component consists of Pt or a Pt alloy of at least 55% by weight Pt, 0 to 30% by weight Rh, 0 to 30% by weight Au, and 0 to 40% by weight Pd.

In a preferred embodiment, the dispersion-strengthening agent comprises at least 90% by weight oxygen-oxidized Ce, particularly if the platinum alloy contains 0 to 30% by weight of Au.

In a further preferred embodiment, the dispersion-strengthening agent comprises at least 90% by weight oxygen-oxidized Zr as the main component of the dispersion-strengthening agent and Sc or Y as secondary components of the dispersion-strengthening agent. Dispersion-strengthened platinum materials with 1 to 4% by weight of Zr and 0.05 to 1% by weight of Sc or Y have proved suitable in cases where the sum total of Sc and Y amounts to a maximum of 1% by weight of the material. Preferably, the mass ratio of Zr to the sum total of Sc and Y is 2:1 to 50:1, preferably 5:1 to 20:1. Dispersion-strengthening agents with Zr as the main component and Sc or Y as the secondary component have proved particularly suitable for dispersion-strengthened platinum materials in cases where the noble metal component comprises Pt and 0 to 30% by weight Rh.

For the production of a dispersion-strengthened platinum material, a solid body of a metal alloy is converted according to the invention from a metal alloy by an at least 90% oxidation of the dispersion-strengthening metal into a dispersion-strengthened platinum material.

DETAILED DESCRIPTION OF THE INVENTION

According to the invention, dispersion-strengthened platinum materials are extremely resistant to wear and tear and stable under abrasive conditions. For example, spark plug electrode tips, glass working tools or parts thereof made of the dispersion-strengthened platinum material according to the invention are particularly durable. Further, the materials have good ductility.

PRACTICAL EXAMPLES

Example 1

7.2 kg of platinum and 0.8 kg of rhodium were melted in a zirconium oxide crucible in a vacuum to form the alloy PtRh10. After melting and degassing, the melt was doped with 350 g of a pre-alloy consisting of PtRh10 with 28% by weight Zr, 1.4% by weight Sc and 2.8% by weight Y and was cast into a chill mold to form an ingot with approximate dimensions of 40 mm×60 mm×160 mm. The analysis of the ingot exhibited a composition of PtRh10 with 11,050 ppm Zr, 510 ppm Sc and 1090 ppm Y. The ingots were planed in order to eliminate casting defects and forged at 1100° C. to form a panel with a cross-section of 10 mm×65 mm. Subsequently, the panels were rolled at 1000° C. to form a metal sheet 4mm thick. In line with the procedure described in German patents DE 197 58 724 C2 and DE 100 46 456 C2, the metal sheet was exposed to an air atmosphere for 14 days at 1000° C.

By hot gas extraction analysis (LECO-process), the oxygen content was determined as being 4380 ppm. In the case of complete oxidation of the Zr doping to $ZrO_2$, of the Sc doping to $Sc_2O_3$ and the Y doping to $Y_2O_3$, the oxygen content would have reached 4430 ppm. This results in a proportion of non-noble metal oxide of approximately 1.7% by weight. Assuming that the oxides have, on average, a density of 6.0 g/cm$^3$ and the PtRh10-matrix has a density of 20.0 g/cm$^3$, this proportion by weight corresponds to a proportion by volume of approximately 5.7% by volume. The metal sheet was rolled at 1100° C. to a thickness of 2.5 mm and annealed in an air atmosphere for 2 hours at 1200° C. In spite of this unusually high proportion by volume of a brittle oxide phase, the metal sheet could subsequently be cold rolled to a thickness of 1.3 mm without difficulty.

Example 2

5 kg of platinum were melted in a zirconium oxide crucible in a vacuum. After melting and degassing, the melt was doped with 215 g of a pre-alloy consisting of Pt with 28% by weight Zr, 2.8% by weight Sc and 2.8% by weight Y and was cast into a chill mold to form an ingot with approximate dimensions of 40 mm×40 mm×150 mm. The analysis of the ingot exhibited a composition of Pt with 10,500 ppm Zr, 1000 ppm Sc and 1150 ppm Y. The ingots were planed in order to eliminate casting defects and were forged at 1000° C. to form a rod with a cross-section of 15 mm×15 mm. Subsequently, the rod was rolled at 1000° C. to form a square wire (4 mm×4 mm). In line with the procedure described in German patents DE 197 58 724 C2 and DE 100 46 456 C2, the wire was exposed to an air atmosphere for 10 days at 1000° C.

By hot gas extraction analysis (LECO-process), the oxygen content was determined as being 4500 ppm. In the case of complete oxidation of the Zr doping to $ZrO_2$, of the Sc doping to $Sc_2O_3$ and the Y doping to $Y_2O_3$, the oxygen content would have reached 4530 ppm. The wire was rolled further as a square profile at 800° C. It was possible to roll the wire to a cross-section of 2.4 mm×2.4 mm without problems. After further annealing treatment for 10 minutes at 1200° C. in an air atmosphere, the wire was processed further at 25° C. in a conventional wire drawing machine. It was possible to draw it to a diameter of 0.6 mm without difficulty. In this state, the material had Vickers hardness HV 0.5=206. After further annealing treatment for 1 hour at 1000° C., the hardness was HV 0.5=79. In the metallographic cut, the structure of the annealed wire exhibited an even distribution of round and elongated oxide particles with dimensions of between <1 μm and 3 μm at distances of approximately 1 to 3 μm.

Wire produced in an analogous manner from a platinum material hardened by oxide dispersion according to DE 100 46 456 A1 with 1800 ppm Zr, 150 ppm Sc, 170 ppm Y, and 770 ppm oxygen had a hardness of 155 and, after annealing for 1 hour at 1000° C. a hardness of 67. The density was measured by water displacement (according to Archimedes) as being 20.42 g/cm$^3$, corresponding to a weight reduction of 4.8% for a given volume. In addition, the material consists of 1.7% by weight of non-noble metal oxide, as a result of which total noble metal savings of 6.5% by volume are obtained per volume unit.

Spark plug electrode tips for use in automobiles were produced from the inventive wire.

Example 3

The sheet from Example 1 was annealed in an air atmosphere for 30 minutes at 1000° C., cold rolled to a thickness of 0.5 mm and again annealed for 30 minutes at 1000° C. By forming and welding according to the tungsten inert gas process a lining for a ceramic agitator was produced by using conventional PtRh10 wire as welding flux. The agitator was used to carry out melting tests on boron silicate glass in an inductively heated crucible of PtRh10 at 1550° C. In comparison with an agitator with a lining of conventional PtRh10 material hardened by oxide dispersion according to patents DE 197 58 724 C2 and DE 100 46 456 C2 with a proportion of non-noble metal oxide of approximately 0.3% by weight, approximately 30% less wear and tear was observed at the edges of the agitator blade after 460 hours operation. No measurable loss of weight was detected.

Example 4

4.75 kg of platinum and 0.25 kg of gold were melted in a zirconium oxide crucible under an argon atmosphere to form the alloy PtAu5. After melting the alloy, the melting chamber was evacuated and 210 g of a pre-alloy consisting of PtAu5 with 30.5% Ce were added to the melt and were cast into a chill mold to form an ingot with approximate dimensions of 30 mm×50 mm×160 mm. The analysis of the ingot exhibited a composition of PtAu5 with 10,350 ppm Ce. The ingot was planed in order to eliminate casting defects and was forged at 1100° C. to form a plate 10 mm thick. Subsequently, the plate was rolled at 1000° C. to form a metal sheet 4 mm thick. The metal sheet was exposed to an air atmosphere for 14 days at 1000° C.

By hot gas extraction analysis (LECO-process), the oxygen content was determined as being 2250 ppm. In the case of complete oxidation of the Ce doping to $CeO_2$, the oxygen content would have reached 2360 ppm. The metal sheet was rolled at 1050° C. to a thickness of 2.5 mm and annealed in an air atmosphere for 2 hours at 1100° C. Subsequently, it was possible to cold roll the sheet metal to a thickness of 0.8 mm.

Following an annealing treatment for 30 minutes at 1000° C., a crucible for the preparation of samples for x-ray fluorescence analysis was made from the metal sheet by pressing (see Runge, M., "Drücken und Drückwalzen" ("Pressing and Pressing Rollers"), Bibliothek der Technik, vol. 72, Verlag Moderne Industrie, Landsberg/Lech (1993)).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A dispersion-strengthened platinum material, comprising a noble metal component and a dispersion-strengthening agent, wherein a proportion by mass of the noble metal component amounts to between 95 and 99% by weight and the noble metal component comprises platinum or a platinum alloy containing at least 55% by weight Pt, 0 to 30% by weight Rh, 0 to 30% by weight Au, and 0 to 40% by weight Pd, and wherein a remaining proportion by mass of more than 1% by weight of the dispersion-strengthened material is the dispersion-strengthening agent, wherein the dispersion-strengthening agent comprises at least 90% by weight metals oxidized with oxygen and comprises Zr and Sc, and wherein the dispersion-strengthened platinum material comprises 1 to 4% by weight Zr and 0.05 to 1% by weight Sc.

2. The dispersion-strengthened platinum material according to claim 1, wherein Sc comprises a maximum of 1% by weight of the material.

3. The dispersion-strengthened platinum material according to claim 1, wherein the mass ratio of Zr to Sc is 5:1 to 20:1.

4. The dispersion-strengthened platinum material according to claim 1, wherein the platinum or platinum alloy comprises Pt and 0 to 30% by weight Rh.

5. The dispersion-strengthened platinum material according to claim 1, wherein the noble metal component consists of Pt or a Pt alloy of at least 55% by weight Pt, 0 to 30% by weight Rh, 0 to 30% by weight Au, and 0 to 40% by weight Pd.

6. The dispersion-strengthened platinum material according to claim 1, wherein the material is stable under abrasive conditions.

7. The dispersion-strengthened platinum material according to claim 1, the material having a form of a spark plug electrode tip.

8. The dispersion-strengthened platinum material according to claim 1, the material having a form of a glass working tool or part thereof.

9. A process for production of a dispersion-strengthened platinum material according to claim 1, the process comprising providing a solid body of a metal alloy comprising less than 99% by weight of noble metal and more than 1% by weight of at least one dispersion-strengthening metal, and converting the solid body into a dispersion-strengthened platinum material by at least 90% oxidation of the at least one dispersion-strengthening metal.

10. A dispersion-strengthened platinum material, comprising a noble metal component and a dispersion-strengthening agent, wherein a proportion by mass of the noble metal component amounts to between 95 and 99% by weight and the noble metal component comprises platinum or a platinum alloy containing at least 55% by weight Pt, 0 to 30% by weight Rh, 0 to 30% by weight Au, and 0 to 40% by weight Pd, and wherein a remaining proportion by mass of more than 1% by weight of the dispersion-strengthened material is the dispersion-strengthening agent, wherein the dispersion-strengthening agent comprises at least 90% by weight metals oxidized with oxygen and comprises Zr, Sc, and Y, and wherein the dispersion-strengthened platinum material comprises 1 to 4% by weight Zr and 0.05 to 1% by weight Sc and Y.

11. The dispersion-strengthened platinum material according to claim 10, wherein a sum total of Sc and Y is a maximum of 1% by weight of the material.

12. The dispersion-strengthened platinum material according to claim 10, wherein the mass ratio of Zr to a sum total of Sc and Y is 5:1 to 20:1.

13. The dispersion-strengthened platinum material according to claim 10, wherein the platinum or platinum alloy comprises Pt and 0 to 30% by weight Rh.

14. The dispersion-strengthened platinum material according to claim 10, wherein the noble metal component consists of Pt or a Pt alloy of at least 55% by weight Pt, 0 to 30% by weight Rh, 0 to 30% by weight Au, and 0 to 40% by weight Pd.

15. The dispersion-strengthened platinum material according to claim 10, wherein the material is stable under abrasive conditions.

16. The dispersion-strengthened platinum material according to claim 10, the material having a form of a spark plug electrode tip.

17. The dispersion-strengthened platinum material according to claim 10, the material having a form of a glass working tool or part thereof.

18. A process for production of a dispersion-strengthened platinum material according to claim 10, the process comprising providing a solid body of a metal alloy comprising less than 99% by weight of noble metal and more than 1% by weight of at least one dispersion-strengthening metal, and converting the solid body into a dispersion-strengthened platinum material by at least 90% oxidation of the at least one dispersion-strengthening metal.

* * * * *